US009038729B2

(12) United States Patent
Leduc et al.

(10) Patent No.: US 9,038,729 B2
(45) Date of Patent: May 26, 2015

(54) ADAPTOR FLANGE FOR ROTARY CONTROL DEVICE

(75) Inventors: Trung Leduc, Houston, TX (US); Sudar Chellappa, Houston, TX (US)

(73) Assignee: Smith International, Inc., Houston, TX (US)

( * ) Notice: Subject to any disclaimer, the term of this patent is extended or adjusted under 35 U.S.C. 154(b) by 809 days.

(21) Appl. No.: 13/247,485

(22) Filed: Sep. 28, 2011

(65) Prior Publication Data

US 2012/0073113 A1 Mar. 29, 2012

Related U.S. Application Data

(60) Provisional application No. 61/387,302, filed on Sep. 28, 2010.

(51) Int. Cl.
*E21B 7/12* (2006.01)
*E21B 33/08* (2006.01)
*E21B 19/00* (2006.01)

(52) U.S. Cl.
CPC ..... *E21B 33/085* (2013.01); *Y10T 29/49963* (2015.01); *Y10T 29/49826* (2015.01); *E21B 19/006* (2013.01)

(58) Field of Classification Search
CPC ..... E21B 33/085
USPC ..... 166/345, 358, 360
See application file for complete search history.

(56) References Cited

U.S. PATENT DOCUMENTS

| | | | | |
|---|---|---|---|---|
| 830,100 | A * | 9/1906 | Post | 384/586 |
| 2,398,459 | A * | 4/1946 | Province | 384/571 |
| 3,052,300 | A | 9/1962 | Hampton | |
| 3,387,851 | A | 6/1968 | Cugini | |
| 3,492,007 | A * | 1/1970 | Jones | 277/325 |
| 3,667,721 | A * | 6/1972 | Vujasinovic | 51/1.1 |
| 3,724,862 | A * | 4/1973 | Biffle | 166/84.3 |
| 3,868,832 | A * | 3/1975 | Biffle | 464/163 |
| 3,965,987 | A * | 6/1976 | Biffle | 166/379 |
| 4,098,341 | A * | 7/1978 | Lewis | 166/387 |
| 4,312,404 | A * | 1/1982 | Morrow | 166/84.3 |
| 4,363,357 | A | 12/1982 | Hunter | |
| 4,480,703 | A * | 11/1984 | Garrett | 175/195 |
| 4,486,025 | A * | 12/1984 | Johnston | 277/343 |
| 4,526,243 | A * | 7/1985 | Young | 175/195 |

(Continued)

FOREIGN PATENT DOCUMENTS

| | | |
|---|---|---|
| RU | 2347060 C1 | 2/2009 |
| SU | 1696766 A1 | 12/1991 |
| SU | 1723398 A1 | 3/1992 |

OTHER PUBLICATIONS

Search Report issued under Eurasian Application No. 201101238 dated Mar. 15, 2012 (4 pages).

(Continued)

*Primary Examiner* — Matthew Buck
*Assistant Examiner* — Aaron Lembo

(57) ABSTRACT

An adapter assembly having a sealing element, a drive bushing, and an adapter flange disposed between the sealing element and the drive bushing. Also, a method of assembling a rotational control device that includes coupling mechanically an adapter flange to a sealing element, coupling mechanically the adapter flange to a drive bushing, and installing the adapter flange, sealing element, and drive bushing in the rotational control device.

19 Claims, 9 Drawing Sheets

(56) References Cited

U.S. PATENT DOCUMENTS

| | | | | | |
|---|---|---|---|---|---|
| 4,531,591 | A | * | 7/1985 | Johnston | 175/57 |
| 4,560,001 | A | | 12/1985 | Gonzales | |
| 4,658,894 | A | * | 4/1987 | Craig | 166/84.1 |
| 4,745,970 | A | * | 5/1988 | Bearden et al. | 166/84.3 |
| 4,754,820 | A | * | 7/1988 | Watts et al. | 175/195 |
| 4,783,084 | A | * | 11/1988 | Biffle | 277/323 |
| 4,825,938 | A | * | 5/1989 | Davis | 166/84.3 |
| 4,828,024 | A | * | 5/1989 | Roche | 166/84.4 |
| 5,022,472 | A | | 6/1991 | Bailey et al. | |
| 5,213,158 | A | * | 5/1993 | Bailey et al. | 166/84.3 |
| 5,224,557 | A | * | 7/1993 | Yenulis et al. | 175/195 |
| 5,647,444 | A | * | 7/1997 | Williams | 175/209 |
| 5,662,181 | A | | 9/1997 | Williams et al. | |
| 5,901,964 | A | * | 5/1999 | Williams et al. | 277/326 |
| 5,996,654 | A | * | 12/1999 | Green | 141/383 |
| 6,016,880 | A | * | 1/2000 | Hall et al. | 175/195 |
| 6,109,348 | A | * | 8/2000 | Caraway | 166/84.3 |
| 6,129,152 | A | * | 10/2000 | Hosie et al. | 166/384 |
| 6,354,385 | B1 | | 3/2002 | Ford et al. | |
| 6,470,975 | B1 | * | 10/2002 | Bourgoyne et al. | 175/57 |
| 6,896,076 | B2 | * | 5/2005 | Nelson et al. | 175/57 |
| 7,258,171 | B2 | * | 8/2007 | Bourgoyne et al. | 166/382 |
| 7,334,633 | B2 | | 2/2008 | Williams et al. | |
| 7,377,334 | B2 | * | 5/2008 | May et al. | 175/57 |
| 7,798,210 | B1 | | 9/2010 | Pruitt et al. | |
| 7,836,946 | B2 | * | 11/2010 | Bailey et al. | 166/84.2 |
| 7,926,593 | B2 | * | 4/2011 | Bailey et al. | 175/87 |
| 7,934,545 | B2 | * | 5/2011 | Bailey et al. | 166/84.2 |
| 7,950,474 | B2 | * | 5/2011 | Leduc et al. | 175/48 |
| 7,997,345 | B2 | * | 8/2011 | Hannegan | 166/345 |
| 8,322,432 | B2 | * | 12/2012 | Bailey et al. | 166/344 |
| 8,701,796 | B2 | * | 4/2014 | Bailey et al. | 175/87 |

OTHER PUBLICATIONS

Partial European Search Report issued in corresponding European Application No. 11183198.8; Dated Apr. 4, 2013 (5 pages).

Official Action issued in corresponding Eurasian Application No. 201101238/ (31) dated Oct. 31, 2013 (4 pages).

Extended European Search Report issued in corresponding European Application No. 11183198.8 dated Aug. 13, 2013 (8 pages).

Official Action issued in corresponding Eurasian Application No. 201101238/31; Dated Jun. 24, 2014 (4 pages).

Examination Report issued in Application No. GC2011-19408; Dated Oct. 19, 2014 (4 pages).

* cited by examiner

ADAPTOR FLANGE FOR ROTARY CONTROL DEVICE

CROSS-REFERENCE TO RELATED APPLICATIONS

This applications claims the benefit of a related U.S. Provisional Application Ser. No. 61/387,302 filed Sep. 28, 2010, entitled "Adapter Flange for Rotary Control Device," to Leduc et al., the disclosure of which is incorporated by reference herein in its entirety.

BACKGROUND

The present disclosure generally relates to apparatus and methods for sealing in offshore wellbores. More particularly, the present disclosure relates to apparatus and methods to seal against a drill pipe in subsea wellbores offshore during drilling operations.

BACKGROUND ART

Wellbores are drilled deep into the earth's crust to recover oil and gas deposits trapped in the formations below. Typically, these wellbores are drilled by an apparatus that rotates a drill bit at the end of a long string of threaded pipes known as a drillstring. Because of the energy and friction involved in drilling a wellbore in the earth's formation, drilling fluids, commonly referred to as drilling mud, are used to lubricate and cool the drill bit as it cuts the rock formations below. Furthermore, in addition to cooling and lubricating the drill bit, drilling mud also performs the secondary and tertiary functions of removing the drill cuttings from the bottom of the wellbore and applying a hydrostatic column of pressure to the drilled wellbore.

As wellbores are drilled several thousand feet below the surface, the hydrostatic column of drilling mud serves to help prevent blowout of the wellbore as well. Often, hydrocarbons and other fluids trapped in subterranean formations exist under significant pressures. Absent any flow control schemes, fluids from such ruptured formations may blow out of the wellbore like a geyser and spew hydrocarbons and other undesirable fluids (e.g., $H_2S$ gas) into the atmosphere. As such, several thousand feet of hydraulic "head" from the column of drilling mud helps prevent the wellbore from blowing out under normal conditions.

However, under certain circumstances, the drill bit will encounter pockets of pressurized formations and will cause the wellbore to "kick" or experience a rapid increase in pressure. Because formation kicks are unpredictable and would otherwise result in disaster, flow control devices known as blowout preventers ("BOPs"), are mandatory on most wells drilled today. One type of BOP is an annular blowout preventer. Annular BOPs are configured to seal the annular space between the drillstring and the inside of the wellbore. Annular BOPs typically include a large flexible rubber packing unit of a substantially toroidal shape that is configured to seal around a variety of drillstring sizes when activated by a piston. Furthermore, when no drillstring is present, annular BOPs may even be capable of sealing an open bore. While annular BOPs are configured to allow a drillstring to be removed (i.e., tripped out) or inserted (i.e., tripped in) therethrough while actuated, they are not configured to be actuated during drilling operations (i.e., while the drillstring is rotating). Because of their configuration, rotating the drillstring through an activated annular blowout preventer would rapidly wear out the packing element.

As such, rotating control devices are frequently used in oilfield drilling operations where elevated annular pressures are present. A typical rotating control device (RCD) includes a packing element and a bearing package, whereby the bearing package allows the packing element to rotate along with the drillstring. Therefore, in using a RCD, there is no relative rotational movement between the packing element and the drillstring, only the bearing package exhibits relative rotational movement.

SUMMARY OF THE DISCLOSURE

In one aspect, embodiments disclosed herein relate to an adapter assembly including a sealing element. Embodiments further include a drive bushing and an adapter flange disposed between the sealing element and the drive bushing.

In another aspect, embodiments disclosed herein relate to a method of assembling a rotational control device including coupling mechanically an adapter flange to a sealing element. Embodiments further include coupling mechanically the adapter flange to a drive bushing and installing the adapter flange, sealing element, and drive bushing in the rotational control device.

In another aspect, embodiments disclosed herein relate to an adapter assembly comprising a first sealing element; a second sealing element. Embodiments also include an adapter flange disposed between the first sealing element and the second sealing element.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

In one aspect, embodiments disclosed herein relate generally to apparatuses and methods for sealing in offshore wellbores. Specifically, the present disclosure relates to apparatus and methods to seal against a drill pipe in subsea wellbores offshore during drilling operations.

Typical RCD sealing elements have metal inserts bonded to an elasotmer portion and are fastened to the RCD bearing assemblies with threaded-bolts. The component of the bearing assembly that is fastened to the sealing elements, called a "drive-bushing," typically has threaded holes drilled into it and a set of screws are then used to securely bolt sealing elements inserted from the bottom-up. The sealing elements that are used in such assemblies are referred to as "bolt-on" assemblies and require cut-aways or grooves to enable the bolting process as well as to accommodate the bolt-heads, which are conventionally larger than the threaded portion of the bolts. The location of the bolt is typically fixed and is the same for all sizes of sealing-elements.

Because conventional sealing-elements are bolted from the bottom-up and the location of the bolts is fixed, the insert's allowable diameter is limited. In such a case when a sufficiently large tool-joint of a size that approaches the insert diameter is stripped through the sealing element, significant shear stress on the elastomer may result in material damage, referred to in the art as "chunking," which is detrimental to the life of the sealing element. Additionally, the cut-away or grooves on the sealing elements that are required for such bottom-up bolting causes some areas of the sealing elements to be effectively thinner in cross-section, thereby causing them to be weaker and more susceptible to failure. Furthermore, bottom-up bolting may result in losing bolts downhole when they are not properly secured, thereby causing damage to drilling tools.

Figure 1:
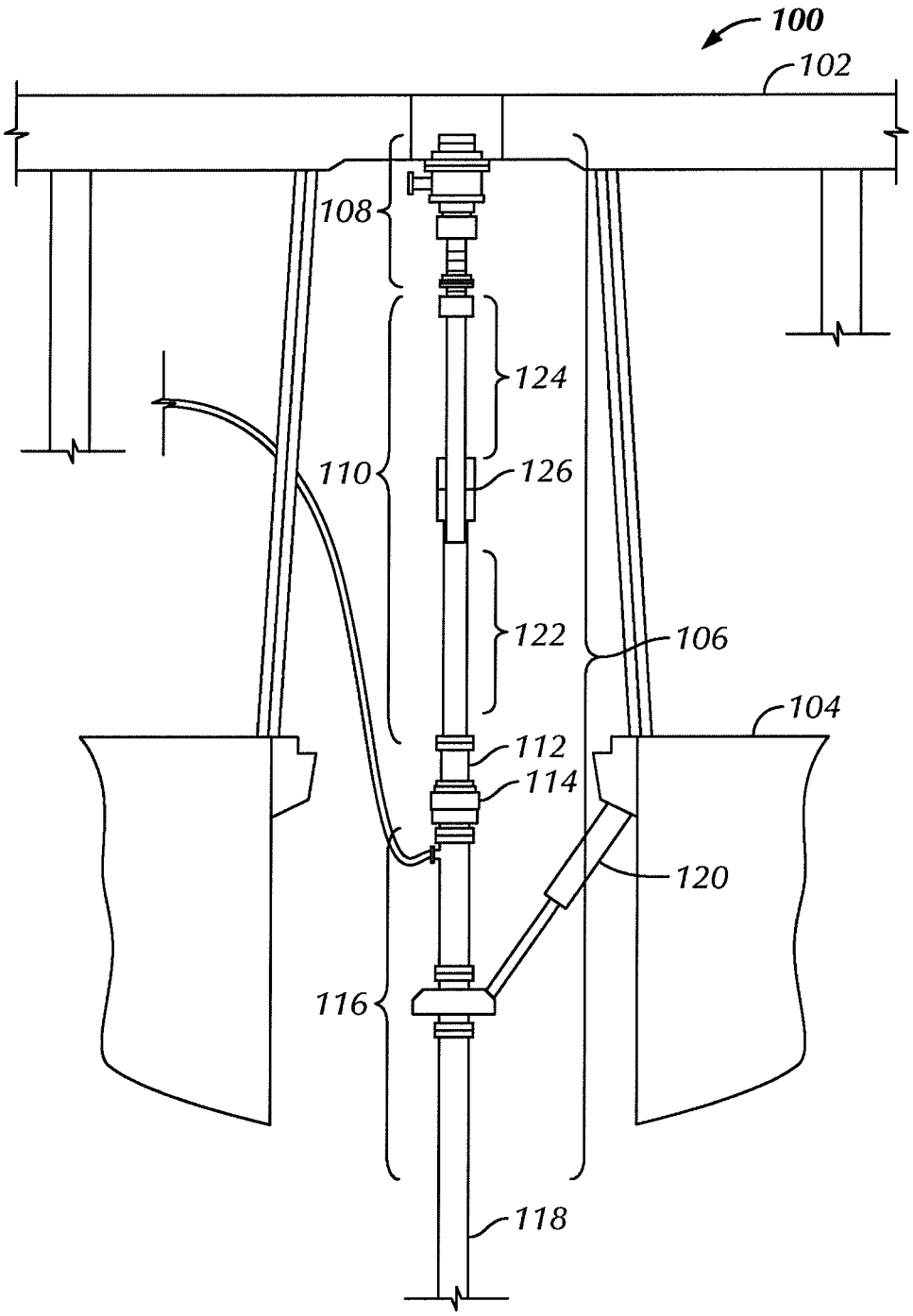
FIG. 1 shows an offshore drilling platform in accordance with embodiments disclosed herein.

Referring to FIG. 1, a portion of an offshore drilling platform 100 is shown. While offshore drilling platform 100 is depicted as a semi-submersible drilling platform, one of ordinary skill will appreciate that a platform of any type may be used including, but not limited to, drillships, spar platforms, tension leg platforms, and jack-up platforms. Offshore drilling platform 100 includes a rig floor 102 and a lower bay 104. A riser assembly 106 extends from a subsea wellhead (not shown) to offshore drilling platform 100 and includes various drilling and pressure control components.

From top to bottom, riser assembly 106 includes a diverter assembly 108 (shown including a standpipe and a bell nipple), a slip joint 110, a rotating control device 112, an annular blowout preventer 114, a riser hanger and swivel assembly 116, and a string of riser pipe 118 extending to subsea wellhead (not shown). While one configuration of riser assembly 106 is shown and described in FIG. 1, one of ordinary skill in the art should understand that various types and configurations of riser assembly 106 may be used in conjunction with embodiments of the present disclosure. Specifically, it should be understood that a particular configuration of riser assembly 106 used will depend on the configuration of the subsea wellhead below, the type of offshore drilling platform 100 used, and the location of the well site.

Because offshore drilling platform 100 is a semi-submersible platform, it is expected to have significant relative axial movement (i.e., heave) between its structure (e.g., rig floor 102 and/or lower bay 104) and the sea floor. Therefore, a heave compensation mechanism must be employed so that tension may be maintained in riser assembly 106 without breaking or overstressing sections of riser pipe 118. As such, slip joint 110 having a lower section 122, an upper section 124, and a seal housing 126, may be constructed to allow 30', 40', or more stroke (i.e., relative displacement) to compensate for wave action experienced by drilling platform 100. Furthermore, a hydraulic member 120 is shown connected between lower bay 104 and hanger and swivel assembly 116 to provide upward tensile force to string of riser pipe 118 as well as to limit a maximum stroke of slip joint 110. To counteract translational movement (in addition to heave) of drilling platform 100, an arrangement of mooring lines (not shown) may be used to retain drilling platform 100 in a substantially constant longitudinal and latitudinal area.

Figure 2A:
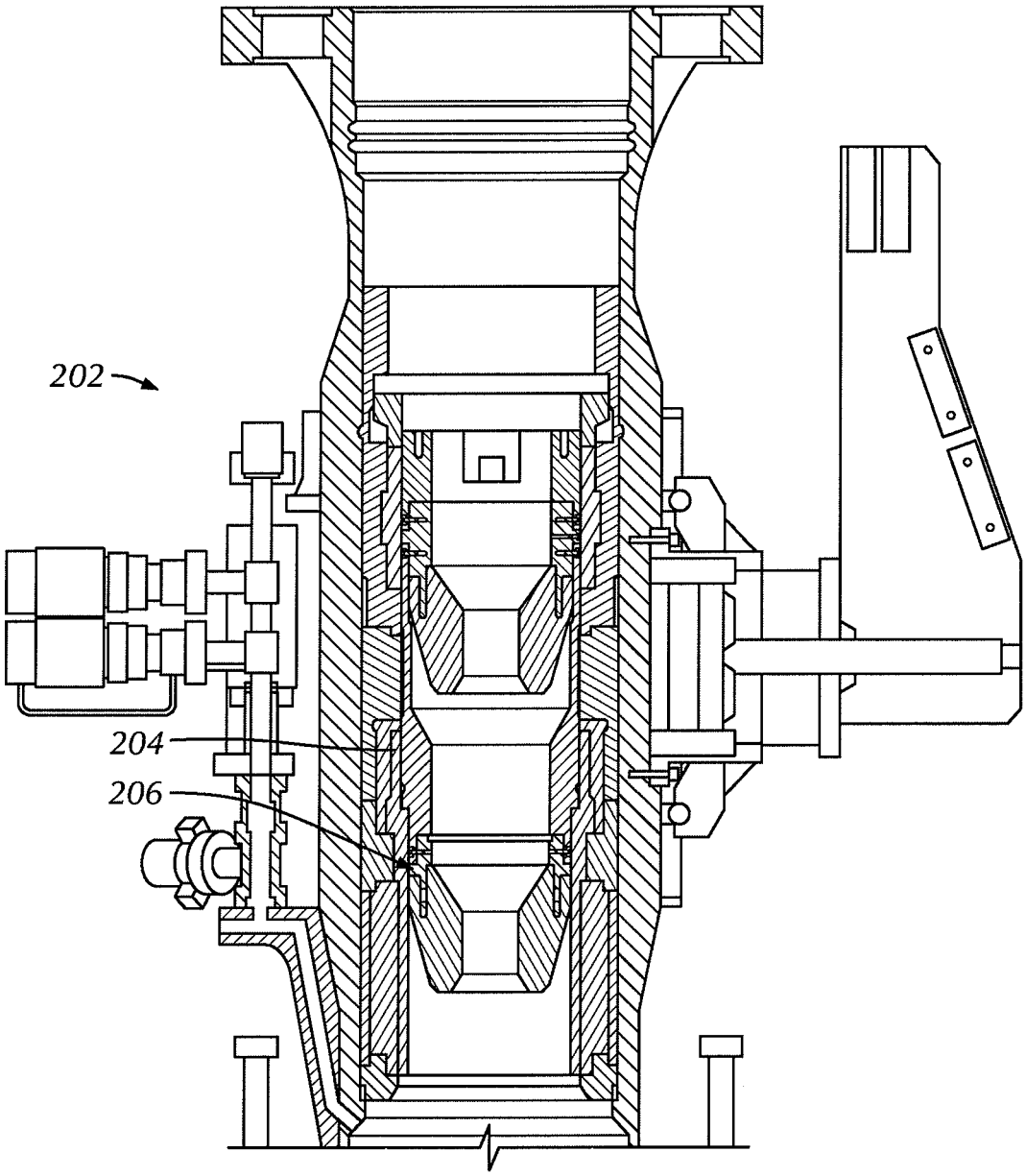
FIG. 2A shows a section view of a rotating control device in accordance with embodiments disclosed herein.

Looking to FIG. 2A, a cross-sectional view of a rotating control device 202 in accordance with embodiments disclosed herein is shown. Rotating control device 202 may include a bearing package 204 and a seal assembly 206 configured to seal against a drillstring (not shown) while allowing rotation of the drill string.

Figure 2B:
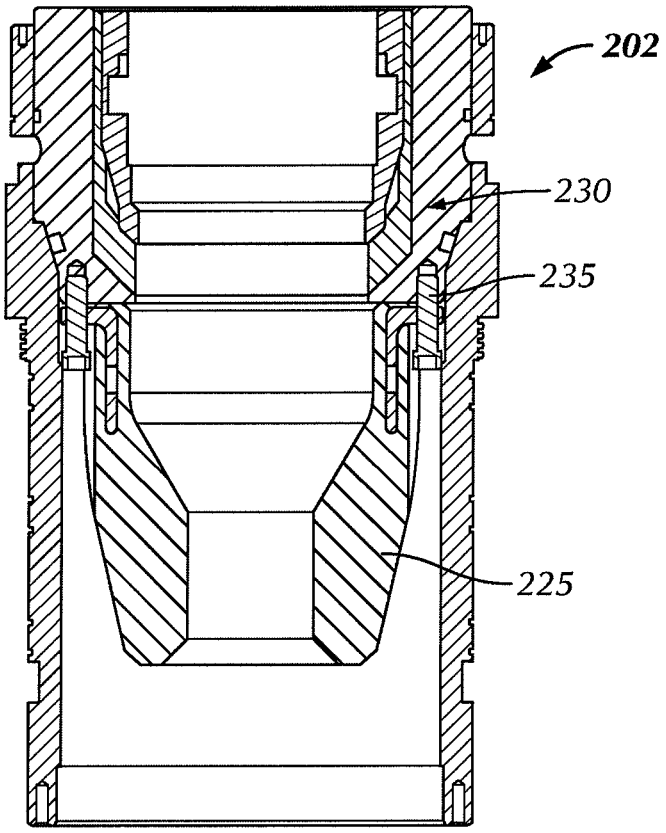
FIG. 2B shows a cross-sectional view of a rotating control device.

Referring to FIG. 2B, a cross-sectional view of a rotating control device 202 is shown. As illustrated, rotating control device 202 includes a drive bushing 230 that is engaged directly to a sealing element 225. Such a configuration is typically referred to as a bolt-on style assembly, as a bolt 235 threadingly engages drive bushing 230 and sealing element 225.

Figure 2C:
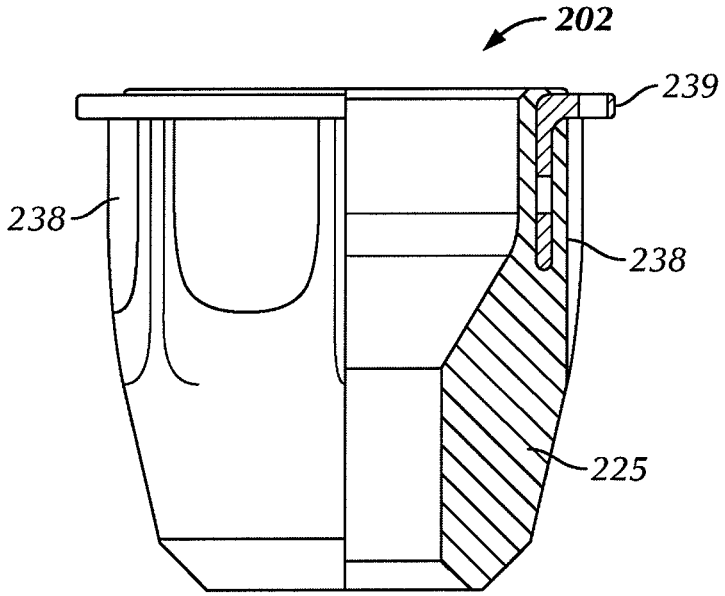
FIG. 2C shows a cross-sectional view of a rotating control device.

Referring to FIG. 2C, a cross-sectional view of a rotating control device 202 is shown. In this illustration, grooves 238 in sealing element 225 allow the sealing element 225 to be coupled directly to a drive bushing (not shown). Thus, during assembly, a bolt (not shown) may be inserted through groove 238, into an aperture 239, such that sealing element 225 may be directly connected to a drive bushing.

Figure 3A:
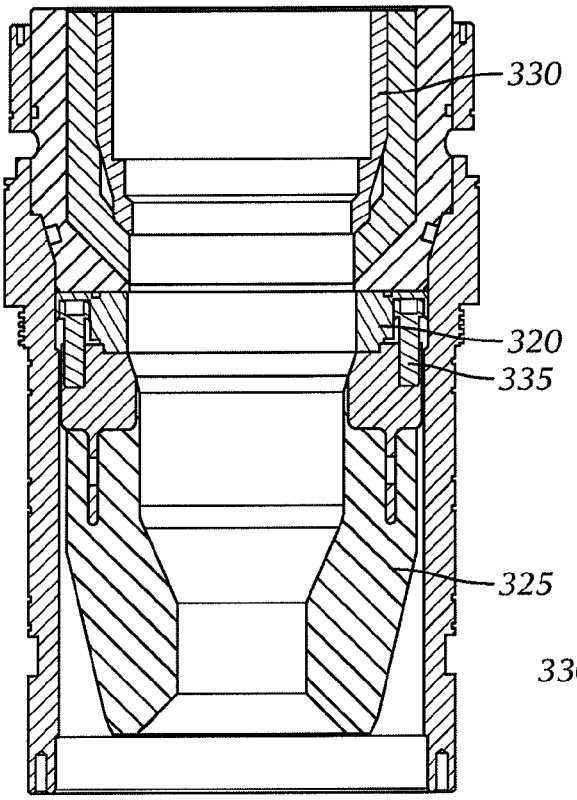
FIGS. 3A and 3B show cross-sectional views of adapter assemblies in accordance with embodiments of the present disclosure.
Figure 3B:
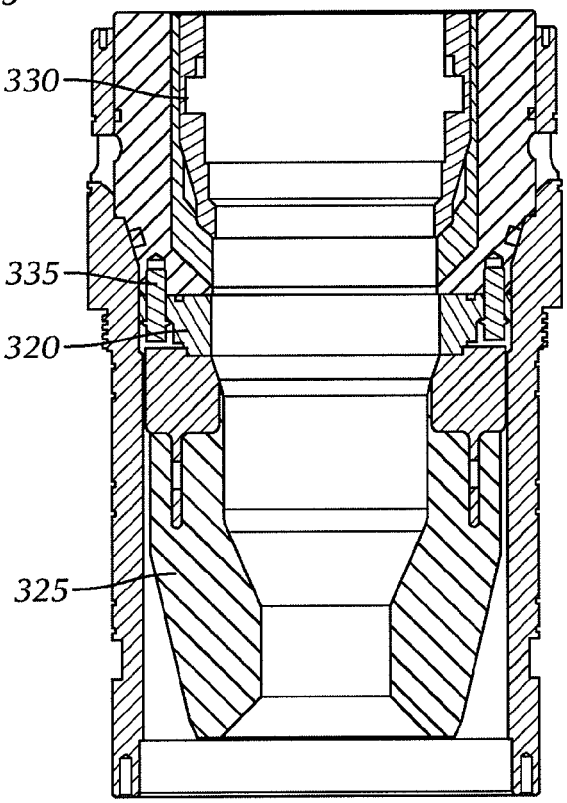

Referring to FIGS. 3A and 3B, cross-sectional views of a sealing element adaptor assembly according to embodiments of the present disclosure are shown. In this embodiment, adapter flange 320 is disposed between sealing elements 325 and drive bushing 330. Multiple mechanical attachment mechanisms, such as screws 335, may be used to secure adapter flange 320 to sealing element 325 and drive bushing 330. In certain embodiments, hex-head locking bolts (not independently illustrated) may be used to attach adapter flange 320 to sealing element 325 and drive bushing 330. In other embodiments, alternative mechanical attachment mechanisms may be used in place of screws, such as bolts, rivets, and the like. Depending on the requirement for the RCD, the number of screws 335 may vary. For example, in certain embodiments, eight screws 335 may be used to attach adapter flange 320 to sealing element 325 and eight screws may be used to attach adapter flange 320 and drive bushing 330. Those of ordinary skill in the art will appreciate that the number and relative orientation of screws 335 around adapter flange 320 may vary depending on the design parameters of the adapter flange, such as the diameter of the flange 320 and the operational requirements of sealing element 325. In certain embodiments, greater or fewer screws 335 may be used to attach adapter flange 320 to sealing element 325 than adapter flange 320 to drive bushing 330, or vice-versa.

By connecting sealing element 325 to drive bushing 330 through adapter flange 320, the insert diameter of the rotary control device may be effectively increased, thereby preventing premature sealing element's 325 failure when large diameter tool joints are used. Additionally, because the sealing element 325 and drive bushing 330 are attached through vertical orientation of an adapter, there is no need for cut-aways or grooves present on typical sealing elements, as described above, thereby allowing for uniform rubber thickness along the circumference of sealing element 325. Additionally, the vertical orientation of sealing element 325, adapter flange 320, and drive bushing 330 hold screws 335 in place, thereby decreasing the risk of losing screws 335 downhole.

Sealing element 325 may be formed from various elastomeric materials such as various rubbers. Examples of rubbers that may be used include nitrile butadiene, hydrogenated nitrile butadiene, natural, nitrile, and polyurethane rubbers. Those of ordinary skill in the art will appreciate that the specific type of rubber may vary depending on the operational requirements of the drilling operation.

Figure 4A:
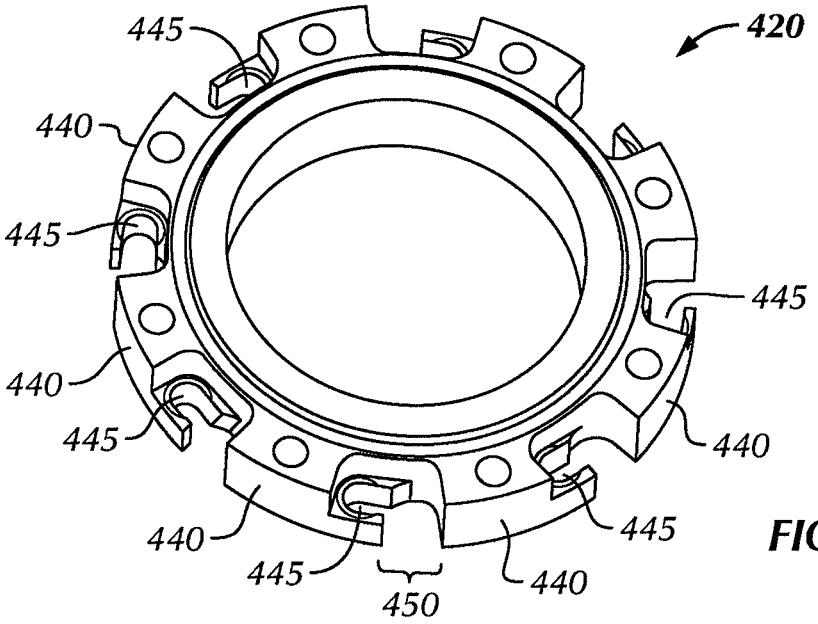
FIGS. 4A and 4B show close-perspective views of adapter flanges in accordance with embodiments of the present disclosure.
Figure 4B:
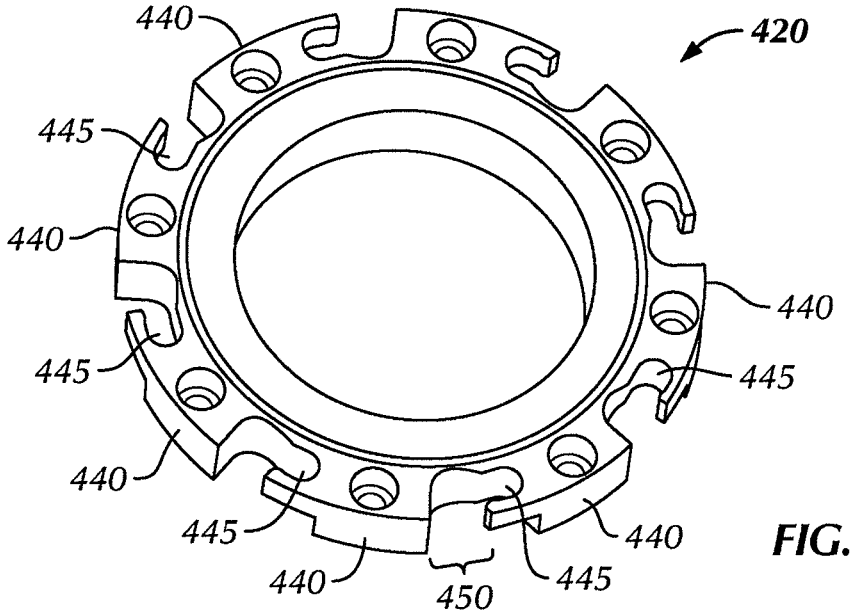

Referring to FIGS. 4A and 4B, bottom and top views of an adapter flange according to embodiments of the present disclosure, respectively, are shown. As illustrated, adapter flange 420 has a plurality of mechanical attachment apertures 440 disposed around adapter flange 420 and configured to receive one or more screws (not shown) or other mechanical attachment devices, such as, bolts, rivets, etc. Screws may be inserted into mechanical attachment apertures 440 during assembly, such that the screws threadingly engage adapter flange 420 to a sealing element (not shown). Thus, adapter flange 420 is secured to sealing element through rotational force applied to a screw, thereby coupling adapter flange 420 to the sealing element.

After attachment of adapter flange 420 to the sealing element, a plurality of screws may be disposed in a second plurality of mechanical attachment apertures 445, thereby allowing adapter flange 420 to be secured to a drive bushing (not shown). In this embodiment, the second plurality of mechanical attachment apertures 445 include an open slot 450, thereby allowing screws to be inserted through open slot 450 such that a screw may be secured against a bearing surface 455. In alternative embodiments, second plurality of mechanical attachment apertures 445 may not include an open slot, and instead, second plurality of mechanical attachment apertures 445 may include a bearing surface against which a screw is inserted, thereby allowing adapter flange 420 to be coupled to the drive bushing.

Figure 4C:
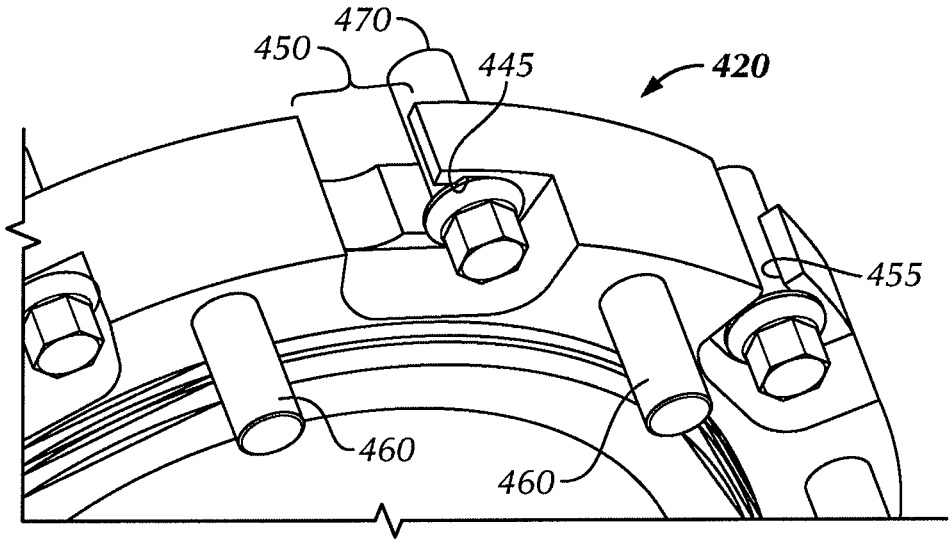
FIGS. 4C and 4D show close-perspective views of adapter flanges in accordance with embodiments of the present disclosure.
Figure 4D:
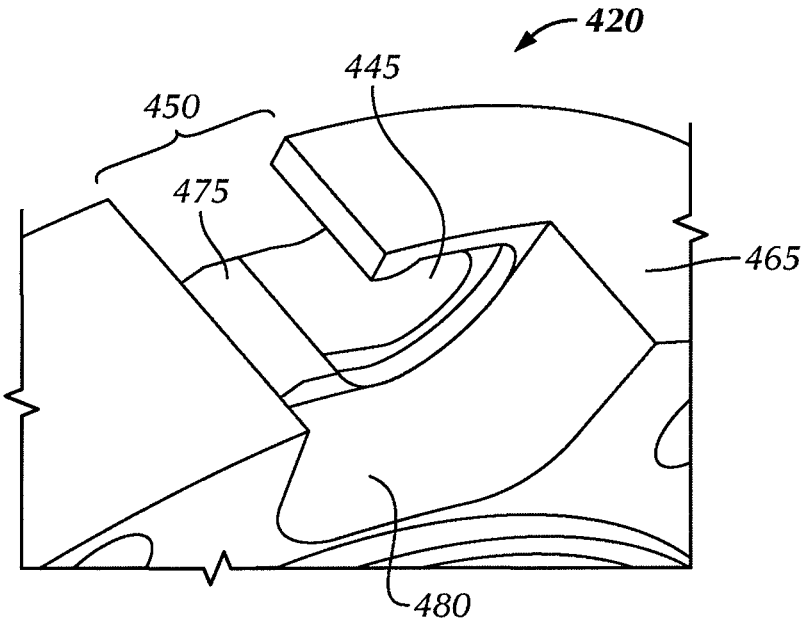

Referring to FIGS. 4C and 4D, close-perspective views of an adapter flange according to embodiments of the present disclosure are shown. As illustrated, adapter flange 420 includes a second plurality of mechanical attachment apertures 445 having an open slot 450. While a plurality of first screws 460 may be used to attached adapter flange 420 to a sealing element (not shown), a second plurality of mechanical screws 470 may be used to couple adapter flange 420 to a drive bushing (not shown). In certain embodiments open slot 450 may further include a locking groove 465. Locking groove 465 may include a recessed bearing surface 455, such that as screws 470 are secured in second plurality of mechanical attachment apertures 445, the screw 470 contacts recessed bearing surface 455. Because the bearing surface 455 has a recessed portion forming a locking groove 465, the bolts are held in position, thereby decreasing the risk of losing bolts down hole during use.

The locking groove 465 may include various geometric features to effectively hold screws 470 in place. For example, in one embodiment, locking groove 465 may include a lip into which a portion of the screw 470 is rotated into during engagement. The lip may then effectively hold screw 470 in place. In an alternate embodiment, locking groove 465 may include a raised portion into which screw 470 may be press fit. In still an alternate embodiment, locking groove 465 may include a progressive wedge having a larger diameter at a top location 475 progressing axially downward to a relatively smaller diameter at a bottom location 480.

Figure 4E:
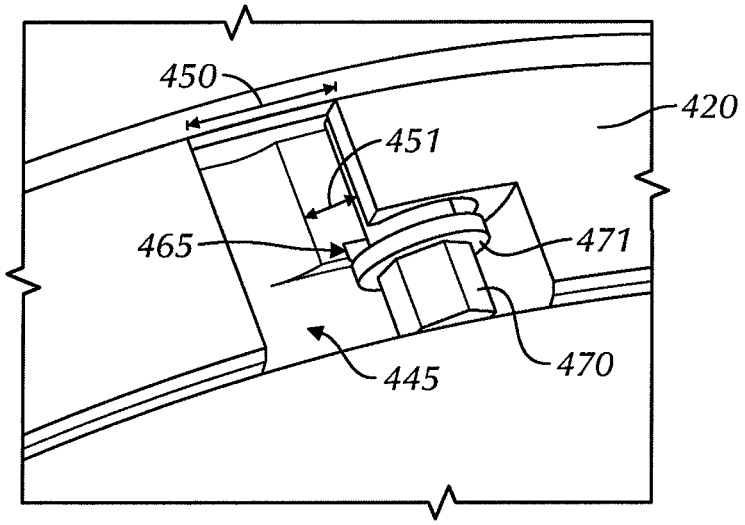
FIGS. 4E and 4F show close-perspective views of adapter flanges in accordance with embodiments of the present disclosure.
Figure 4F:
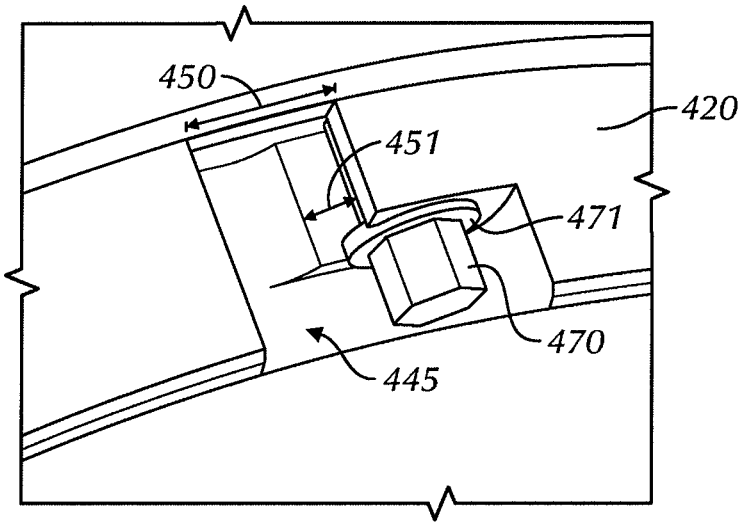

Referring to FIGS. 4E and 4F, close perspective views of an adapter flange according to embodiments of the present disclosure are shown. As illustrated, adapter flange 420 includes a plurality of mechanical attachment apertures 445 having an open slot 450. Mechanical attachment apertures 445 have a slot width 451 wide enough to allow screws 470 to be inserted therein. The adapter flange 420 (of FIG. 4E) may then be rotated into place (FIG. 4F illustrates final orientation of screw 470 within locking groove 465), and the screws 470 may be locked in place through tightening. Because the slot width 451 is smaller than a head 471 of screws 470, the screws 470 cannot pass through the slot, thereby effective locking the screws 470 in place.

Figure 5A:
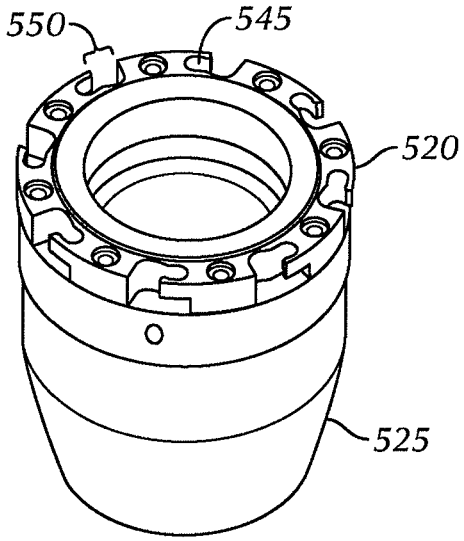
FIG. 5A-5C show perspective views of adapter assembly components in accordance with embodiments of the present disclosure.
Figure 5B:
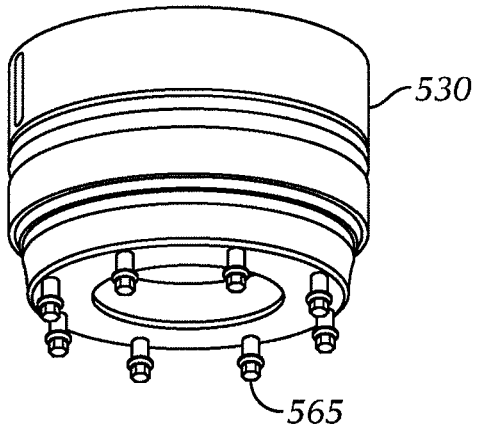
Figure 5C:
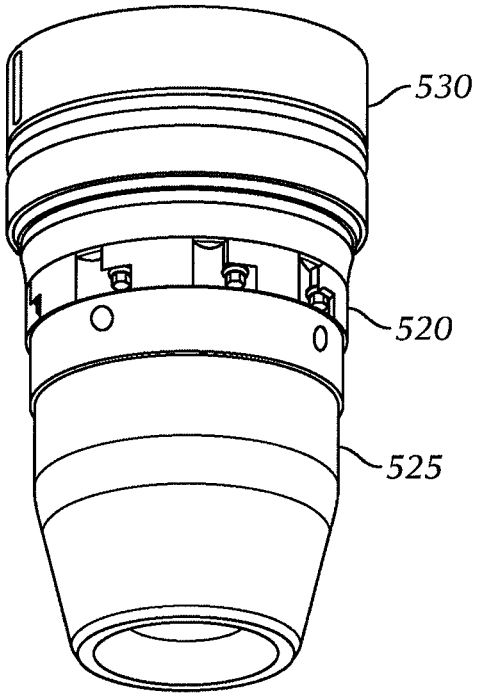

Referring to FIGS. 5A-5C, perspective views of an adapter flange assembly according to embodiments of the present disclosure are shown. During assembly of an RCD having a sealing element 525, an adapter flange 520, and a drive bushing 530, in accordance with embodiments of the present disclosure, adapter flange 520 may first be secured to sealing element 525 by threadingly engaging screws through adapter flange 520 into engagement with sealing element 525. Drive bushing 520, including a plurality of screws 565 extending downwardly therefrom may then be disposed over adapter flange 520, such that screws 565 fit through open slots 550 and into second mechanical attachment apertures 545. The drive bushing 530 may then be rotated to "lock" screws 565 in second mechanical attachment apertures 545. Screws 565 may then be tightened by inserting a wrench into open slots 550 and tightening screw 565 until adapter flange 520 is coupled to drive bushing 530. In certain embodiments, those of ordinary skill in the art will appreciate that the reverse assembly of sealing element 525, an adapter flange 520, and a drive bushing 530 may occur, such that adapter flange 520 is coupled to drive bushing 530 and subsequently coupled to sealing element 525.

In an alternate embodiment, an adapter flange may be coupled to a drive bushing through apertures, and adapter flange subsequently coupled to a sealing element through engagement of screws upwardly extending from the sealing element. The sealing element may then be "locked" in place by rotation of the sealing element relative to the adapter flange, such as through an open slot on the adapter flange. The screws may then be tightened, thereby securing the adapter flange to the sealing element.

Figure 6A:
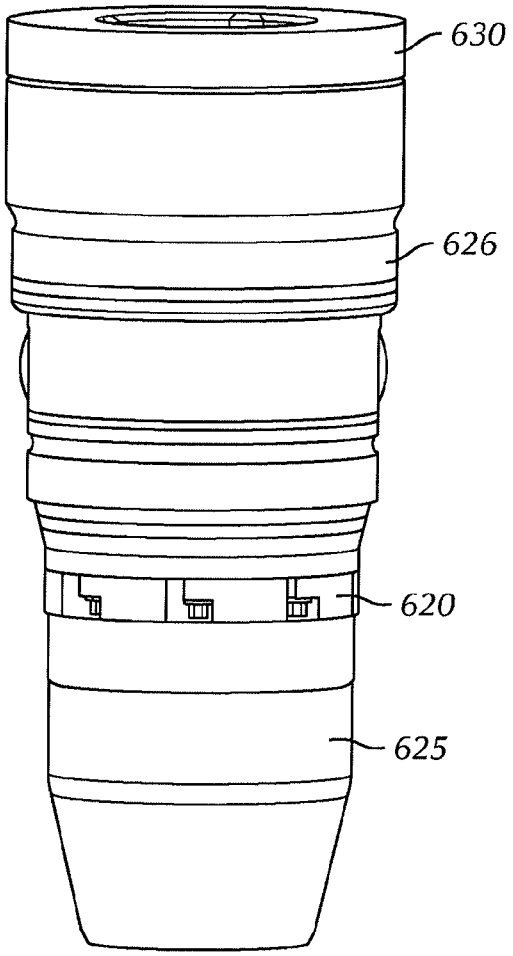
FIGS. 6A and 6B show a perspective views and a cross-sectional view of an adapter flange assembly in accordance with embodiments of the present disclosure.
Figure 6B:
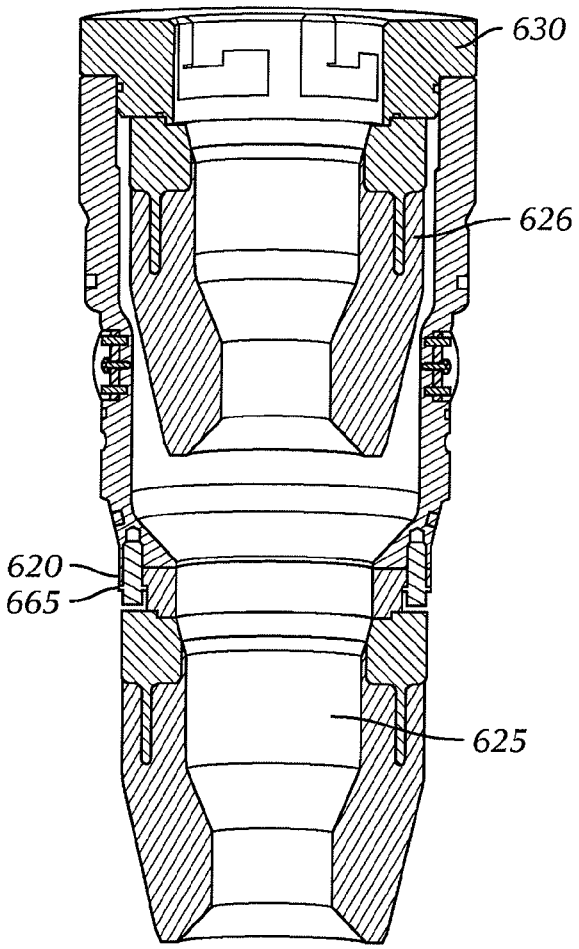

Referring to FIGS. 6A and 6B, a perspective view and a cross-sectional view of an adapter flange assembly according to embodiments of the present disclosure are shown. In this embodiment, an adapter flange 620 provides an intermediary connection between a first sealing element 625 and a second sealing element 626. As illustrated, adapter flange 620 is coupled to first sealing element 625 and subsequently coupled to second sealing element 626 using a plurality of screws 665. Those of ordinary skill in the art will appreciate that in alternate embodiments, an RCD assembly may include more than two sealing elements, such as 3, 4, 5, or more sealing elements.

In the embodiment illustrated in FIGS. 6A and 6B, a single adapter flange 620 is used to couple first and second sealing elements 625 and 626. Second sealing element 626 is connected to drive bushing 630 through conventional means. However, in alternate embodiments, a plurality of adapter flanges may be used, so that, for example, adapter flange 620 couples first and second sealing elements 625 and 626, while a second adapter flange (not shown) is used to connect second sealing element 626 to drive bushing 630. In still other embodiments, first and second sealing elements 625 and 626 may be coupled using conventional means, while second sealing element 626 is coupled to drive bushing 630 with an adapter flange (not shown).

Advantageously, embodiments of the present disclosure may provide apparatuses and methods for attaching drive bushings and sealing elements of RCDs through use of an adapter flange. The adapter flange may advantageously allow for the vertical coupling of drive bushing and sealing elements without the requirement to decrease the volume of elastomer in the sealing element. Because elastomer volume may be maintained, the strength of the seal may be increased, thereby decreasing the likelihood of premature failure. Also advantageously, embodiments of the present disclosure may provide locking grooves at the mechanical attachment locations, thereby preventing mechanical fasteners from being lost downhole, which in conventional assemblies could result in damage to drilling tools.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed:

1. An adapter assembly comprising:

a sealing element;

a drive bushing; and an adapter flange disposed between the sealing element and the drive bushing, the adapter flange including a first plurality of mechanical attachment apertures and a second plurality of mechanical attachment apertures, wherein the second plurality of mechanical attachment apertures is formed to have a slot open to an outer periphery of the adapter flange.

2. The adapter assembly of claim 1, wherein the adapter flange is coupled to the sealing element with a plurality of mechanical attachment mechanisms.

3. The adapter assembly of claim 2, wherein the plurality of mechanical attachment mechanisms comprises at least one of a plurality of screws and bolts.

4. The adapter assembly of claim 3, wherein the bolts are hex bolts.

5. The adapter assembly of claim 2, wherein the plurality of mechanical attachment mechanisms are axially aligned with apertures in the sealing element.

6. The adapter assembly of claim 2, wherein the adapter flange is coupled to the drive bushing with a second plurality of mechanical attachment mechanisms.

7. The adapter assembly of claim 6, wherein the second plurality of mechanical attachment mechanisms are axially aligned with apertures in the drive bushing.

8. The adapter assembly of claim 7, wherein the second plurality of mechanical attachment mechanisms comprises at least one of a plurality of screws and bolts.

9. The adapter assembly of claim 1, wherein the second plurality of mechanical attachment apertures comprises a locking groove.

10. The adapter assembly of claim 9, wherein the locking groove comprises a progressive wedge geometry.

11. A method comprising:

coupling mechanically an adapter flange to a sealing element of a rotational control device;

coupling mechanically the adapter flange to a drive bushing by rotating at least one of the adapter flange or the drive bushing relative to the other thereby sliding a plurality of bolts coupled to the drive bushing from an outer periphery of the adapter flange along a corresponding slot disposed in the adapter flange such that the plurality of bolts coupled to the drive bushing is secured in the adapter flange; and installing the adapter flange, sealing element, and drive bushing in the rotational control device.

12. The method of claim 11, wherein the coupling mechanically the adapter flange to the sealing element comprises installing the plurality of bolts.

13. The method of claim 11, wherein coupling mechanically the adapter flange to the drive bushing comprises installing the plurality of bolts.

14. The method of claim 12, wherein the plurality of bolts are threaded into a locking groove of the adapter flange.

15. The method of claim 12, wherein the plurality of bolts are axially aligned with the sealing element and the adapter flange.

16. The method of claim 13, wherein the plurality of bolts are axially aligned with the drive bushing.

17. An adapter assembly comprising:

a first sealing element;

a second sealing element;

an adapter flange disposed between the first sealing element and the second sealing element; and a plurality of mechanical fasteners configured to couple the adapter flange to an upper surface of a first sealing element and a bottom surface of a second sealing element.

18. The adapter assembly of claim 17, further comprising a drive bushing connected to the second sealing element.

19. The adapter assembly of claim 18, further comprising a second adapter assembly coupled to the second sealing element and the drive bushing.

* * * * *